United States Patent [19]

Dahan

[11] Patent Number: 4,507,830

[45] Date of Patent: Apr. 2, 1985

[54] HOLDER FOR SHEET-LIKE OBJECTS

[76] Inventor: Israel Dahan, 307/46 Gilo, Jerusalem, Israel

[21] Appl. No.: 506,329

[22] Filed: Jun. 21, 1983

[30] Foreign Application Priority Data

Jul. 2, 1982 [IL] Israel ..... 66218

[51] Int. Cl.[3] ..... A44B 21/00; A47F 7/16

[52] U.S. Cl. ..... 24/527; 24/523; 24/115 L; 24/116 A; 211/45; 248/316.3

[58] Field of Search ..... 24/116 A, 115 L, 522, 24/523, 524, 525, 526, 527, 136 A; 248/113, 316.3; 211/45

[56] References Cited

U.S. PATENT DOCUMENTS

| | | | |
|---|---|---|---|
| 330,991 | 11/1885 | Mathews | 24/523 |
| 446,486 | 2/1891 | Van Benthuysen | 211/45 |
| 626,089 | 5/1899 | Pancoast | 248/316.3 |
| 633,237 | 9/1899 | Egbert | 248/316.3 |
| 992,001 | 5/1911 | King | 24/116 A |
| 1,327,925 | 1/1920 | Schneider | 24/116 A |
| 2,889,720 | 6/1959 | Tozier | 24/523 |
| 2,893,089 | 7/1959 | Bacon | 24/116 A |
| 3,385,050 | 5/1968 | Hall | 24/116 A |
| 3,434,686 | 3/1969 | Aoi | 211/45 |
| 4,085,848 | 4/1978 | Tsuge | 211/45 |

FOREIGN PATENT DOCUMENTS

| | | | |
|---|---|---|---|
| 867202 | 7/1949 | Fed. Rep. of Germany | 24/116 A |
| 185107 | 9/1963 | Sweden | 24/115 L |
| 383799 | 1/1965 | Switzerland | 24/116 A |

*Primary Examiner*—Victor N. Sakran

*Attorney, Agent, or Firm*—Wolf, Greenfield & Sacks

[57] ABSTRACT

The present invention relates to a rapid-action holder for sheet-like objects.

While there is no lack of means for affixing sheet-like, nonrigid or semi-rigid material to wall or other surfaces, the application of such means—nails, drawing pins, adhesive tape, staples and the like—is not only time consuming, but the very act of applying such means, and frequently also the removal thereof, is liable to cause damage to both the wall surface and the sheet-like material.

7 Claims, 7 Drawing Figures

HOLDER FOR SHEET-LIKE OBJECTS

It is one of the objects of the present invention to provide a holder for such sheet-like objects as maps, large architectural drawings, and plans, charts, diagrams, enlarged photographs and the like, particularly for such short-time uses as in lectures, demonstrations, board meetings, conferences and the like, where such material has to be displayed for minutes only, to be replaced with a minimum investment in time and effort by other material.

This, the present invention achieves by providing a rapid-action holder for sheet-like objects, comprising a profiled rail mountable on a wall or the like, said rail having in the position of mounting a substantially inverted-u-shaped cross section, the two flanges of which include with one another a relatively small angle in such a way that the inside of said U-shaped cross section is narrowest at the mouth portion thereof, and is widening towards the web portion thereof, a plurality of beads linked to one another to form a coherent chain, said beads being too large to pass said narrowest portion of said U-shaped cross section, yet being small enough to freely move in the wider portion thereof, one end of said chain of beads being fixedly attached to one end of said rail, the other end of said chain of beads being pullably attached to the other end of said rail, said points of attachment at said rail ends being located at such a distance from said mouth portion that, whereas in the non-pulled state of said other end of said chain of beads at least some of said beads are resting within the mouth portion of said cross section touching both flanges, in the pulled state of said other end said chain of beads is tightened and said resting beads thereby lifting until none of said beads touches more than one of said flanges.

While the invention will now be described in connection with certain preferred embodiments, it will be understood that it is not intended to limit the invention to these particular embodiments. On the contrary, it is intended to cover all alternatives, modifications and equivalent arrangements as may be included within the scope of the invention as defined by the appended claims. Nevertheless, it is believed that embodiments of the invention will be more fully understood from a consideration of the following illustrative description read in conjunction with the accompanying drawings, in which:

BRIEF FIGURE DESCRIPTION

DETAILED DESCRIPTION

Figure 1:
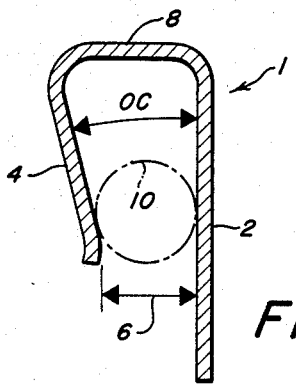
FIG. 1 shows a cross-sectional view of the profiled rail according to the invention.

Referring now to the drawings, there is seen in FIG. 1 the cross section of a profiled rail 1. In the position shown which is the mounting position of the rail, the cross section is in the shape of an inverted U, in which the two flanges 2 and 4 include with one another a relatively small angle, the narrowest part of the U-shape being at its mouth portion 6, fron which it widens toward its web portion 8. It is also seen that the flange 2, with which the holder is to be attached to a wall or similar surface 9 (FIG. 2), is longer than the flange 4.

Figure 2:
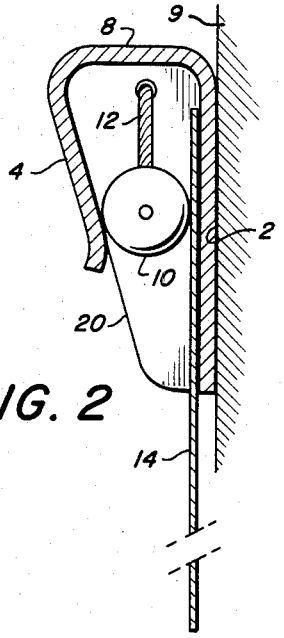
FIG. 2 is a cross-sectional view of the complete holder as mounted on a wall.
Figure 3:
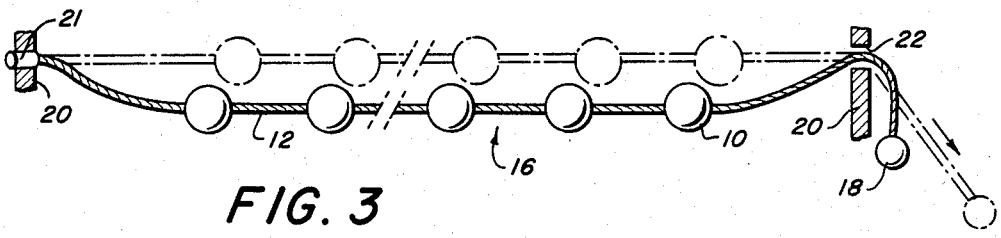
FIG. 3 is a schematic view of the release mechanism.

The holding or clamping effect is produced by a plurality of beads 10 as shown in FIGS. 2 and 3. These beads 10 are too large to pass through the narrowest portion 6 of the profile (see FIG. 1), but small enough to freely move in the wider portion. They are threaded on a length of cord 12 and spaced at predetermined intervals, forming a chain of beads 16. When, as shown in FIG. 2, a sheet 14 of, e.g., paper is pushed into the rail 1 behind the beads 10, the latter, from the position shown in FIG. 1 in which they touch both flanges 2 and 4, are easily lifted by the sheet 14 for the short distance required to let it pass behind the beads 10. When now a downward pull is applied to the sheet 10, either manually or merely due to gravity, the smallest movement downwards will cause the beads 10 to be "rolled" into the narrow portion, forcing the sheet 14 against the flange 2.

While this wedging or jamming action of spherical (or cylindrical) bodies is per se well-known and used in many mechanical devices, it is the way these beads are unwedged or unjammed that is unique to the holder according to the present invention.

This unwedging action is clearly understood from the schematic drawing of FIG. 3, showing in solid lines the chain of beads 16 in what can be termed its slack state, in which the beads 10 either touch both flanges 2 and 4, as shown in FIG. 1, or, with a sheet inserted, touch the latter as well as one flange as in FIG. 2. When now the knob 18 is pulled, the chain of beads is stretched tight and assumes the shape indicated by the broken lines. It is clearly seen that this tightening causes the beads 10 to be lifted. It is this lifting that unwedges the beads 10 and releases the sheet 14.

Figure 4:
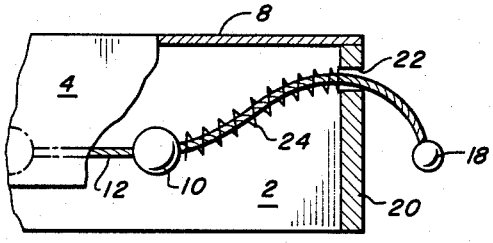
FIG. 4 shows the mounting of a compression spring for re-slackening of the chain of beads.

The ends of the profiled rail 1 are closed by end plates 20 (FIG. 2), to a hole 21 in one of which the fixed end of the cord 12 of the chain of beads 16 is attached. Through a hole 22 in the other plate 20 passes in the embodiment of FIG. 4 the pullable end of the cord 12. To return the chain of beads 16 to its slack state after having been pulled tight to release a sheet 14, a small helical spring 24 can be provided, which is compressed when the knob 18 is pulled for release of a sheet end, pulling back the end of the cord 12 when the knob 18 is released, permits the chain to revert to its slack state. It is obvious that the holes 21 and 22 must be high enough above the beads 10 shown in solid lines in FIG. 3, to produce the lifting effect mentioned, when the cord is pulled tight.

Figure 5:
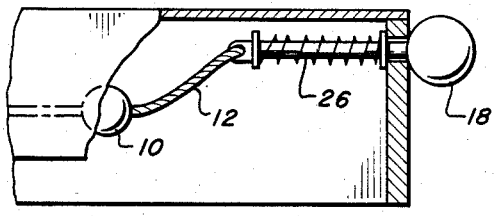
FIG. 5 illustrates another method of mounting such a spring.

FIG. 5 shows a different way of mounting the restoring spring 24, using a rigid bar or tube 26, to which the knob 18 is attached.

Figure 6:
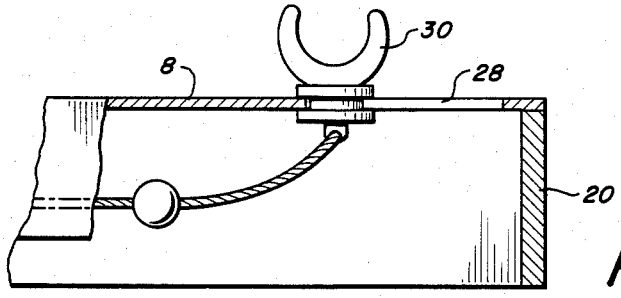
FIG. 6 shows a finger grip for tightening and slackening the chain of beads.

Another way to release a clamped sheet 14 and to reslacken the chain of beads 16 is illustrated in FIG. 6. Here a slot 28 is provided in the end portion of the web 8 of the rail 1, in which slot is slidably mounted a finger grip 30. By pulling the grip 30 to the right, release is effected. By shifting it back to the left, the chain of beads 16 is slackened again.

Figure 7:
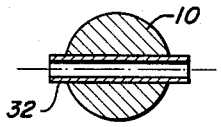
FIG. 7 illustrates a method of fixing a bead to the cord.

The permanency of the spacing of the beads 10 along the cord 12 can be ensured in several ways. Knots can be tied in the cord 12 immediately behind and in front of each bead 10 which are thus held in position between two knots each. Another way of ensuring the position of each bead 10 is illustrated in FIG. 7. Here, pieces of thin-walled metal tubing 32 are introduced into each bead 10. The tubing 32 slightly protrudes on each side of the bead 10 and, the beads having been strung, the protruding tube ends are crimped onto the cord 12. The crimping deformation also prevents the beads from sliding off the pieces of tubing 32. A relatively inexpensive way to mass-produce such chains of beads would be to mold, in a continuous molding process, beads onto cord and cutting the thus obtained endless chain of beads into pieces of the required length.

It would also be possible to use as chain of beads 16 lengths of ready-made, commercially available metal bead chains.

While spherical beads have been seen to give best results, it would nevertheless be possible to use cylindrical or ellipsoid beads, or beads conforming to the shape of other solids of revolution.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A rapid-action holder for sheet-like objects, comprising a profiled rail mountable on a wall or the like, said rail having in the position of mounting a substantially inverted-U-shaped cross section, the two flanges of which include with one another a relatively small angle in such a way that the inside of said U-shaped cross section is narrowest at the mouth portion thereof and is widening towards the web portion thereof, a plurality of beads linked to one another to form a coherent chain, said beads being too large to pass said narrowest portion of said U-shaped cross section, yet being small enough to freely move in the wider portion thereof, one end of said chain of beads being fixedly attached to one end of said rail, the other end of said chain of beads being pullably attached to the other end of said rail, said points of attachment at said rail ends being located at such a distance from said mouth portion that, whereas in the non-pulled state of said other end of said chain of beads at least some of said beads are resting within he mouth portion of said cross section touching both flanges, in the pulled state of said other end said chain of beads is tightened and said resting beads thereby lifted until none of said beads touches more than one of said flanges.

2. The holder as claimed in claim 1, wherein said beads are substantially identical and substantially spherical.

3. The holder as claimed in claim 1, wherein one of said flanges is longer than the other flange.

4. The holder as claimed in claim 1, wherein spring means are provided to return said chain of beads from said pulled to said non-pulled state.

5. The holder as claimed in claim 1, wherein a finger grip is provided for tightening said chain as well as for the slackening thereof.

6. A rapid-action holder for sheet like objects, comprising a profiled rail mountable on a wall or the like, said rail having in the position of mounting a substantially inverted-U-shaped cross section, the two flanges of which include with one another a relatively small angle in such a way that the inside of said U-shaped cross section is narrowest at the mouth portion thereof and is widening towards the web portion thereof, a chain comprising a cord, a plurality of beads threaded in a spaced-apart relationship on said cord and means for fixing said relationship of said beads, said beads being too large to pass said narrowest portion of said U-shaped cross section, yet being small enough to freely move in the wider portion thereof, one end of said chain of beads being fixidly attached to one end of said rail, the other end of said chain of beads being pullably attached to the other end of said rail, said points of attachment at said rail ends being located at such a distance from said mouth portion that, whereas in the non-pulled state of said others end of said chain of beads at least some of said beads are resting within the mouth portion of said cross section touching both flanges, in the pull state of said other end said chain of beads is tightened and said resting beads thereby lifted until none of said beads touches more than one of said flanges.

7. The holder as in claim 6, wherein said beads are molded onto said cord.

* * * * *